US006814582B2

(12) United States Patent
Vadasz et al.

(10) Patent No.: US 6,814,582 B2
(45) Date of Patent: Nov. 9, 2004

(54) REAR INTERCONNECT BLADE FOR RACK MOUNTED SYSTEMS

(75) Inventors: Istvan Vadasz, Munich (DE); Stefan Hofmann, Gauting (DE)

(73) Assignee: Force Computers, Inc., Fremont, CA (US)

( * ) Notice: Subject to any disclaimer, the term of this patent is extended or adjusted under 35 U.S.C. 154(b) by 0 days.

(21) Appl. No.: 10/291,024

(22) Filed: Nov. 8, 2002

(65) Prior Publication Data

US 2004/0092168 A1 May 13, 2004

(51) Int. Cl.[7] ..... H01R 12/00
(52) U.S. Cl. ..... 439/61; 439/608
(58) Field of Search ..... 439/61, 65, 608, 439/610; 361/788

(56) References Cited

U.S. PATENT DOCUMENTS 6,422,876 B1 * 7/2002 Fitzgerald et al. ..... 439/61
6,478,625 B2 * 11/2002 Tolmie et al. ..... 439/608
6,663,427 B1 * 12/2003 Billman et al. ..... 439/608
6,685,511 B2 * 2/2004 Akama et al. ..... 439/610

* cited by examiner

*Primary Examiner*—Gary Paumen
(74) *Attorney, Agent, or Firm*—Thelen Reid & Priest LLP

(57) ABSTRACT

There is provided a system for connecting signals between at least two electronic modules. The interconnection conduits are provided via one or more blades, which are equipped with connection areas along their edge toward the modules. This structure opens up more room for high frequency signaling connections. The blades used for the interconnect can be replaced in a live system during operational conditions.

25 Claims, 4 Drawing Sheets

REAR INTERCONNECT BLADE FOR RACK MOUNTED SYSTEMS

BACKGROUND OF THE INVENTION

Backplanes are used in rack mounted systems to provide interconnections between electronic devices mounted within the rack. Specifically, electronic devices such as processors, interfaces, switches, etc., are supported within a slot of the rack. The said devices are prepared to be inserted into one of the said slots provisioned with connections to the backplane mounted within the rack. Commonly, the electronic device will have a connector, which mates with the corresponding connector of the backplane. The backplane provides interconnection of signals between the devices mounted within the rack and devices external to the rack.

However, prior art backplanes do not provide a good solution for high speed differential signaling above 2.5 Gb/s. The prior art backplane may include ten to thirty layers for interconnections between different slots of the rack system. The problems is that the higher the signaling frequency the higher the losses in signal strength. Specifically, anytime a single interconnect is switched, there is a pulse to the signal trace in the backplane and the material surrounding the trace reacts to this electromagnetic change. The molecules surrounding the trace change orientation due to the pulse in the trace such that heat is generated, thereby causing the amplitude of the signals to decrease. Accordingly, the signals will exhibit a loss in signal strength and be more susceptible to interference.

The prior art backplane is a per se non-exchangeable component of the systems built with them. This specifically prohibits the installation of active or even passive components on the backplanes for high availability systems.

The present invention addresses the above-mentioned deficiencies in the prior art backplane by providing a backplane that minimizes losses in the signals. Specifically, the rear interconnect system of the present invention provides a point to point interconnect method, which supports higher frequency interconnect protocols by reducing the signal loss.

SUMMARY OF THE INVENTION

In accordance with the present invention, there is provided a system for transferring signals between at least two electronic modules. The system includes at least one interconnect blade in communication with each of the electronic modules or a subset thereof. The signal or signal pair traces implemented on the interconnect blades may connect to exactly two electronic modules, or they may form a bus connecting to several electronic modules.

Each of the interconnect blades has a substrate and at least two contact areas formed on the substrate. Each contact area connects to a respective one of the electronic modules. Disposed on each of the substrates is at least one conduit operative to transfer the signals. The conduits may comprise wires or optical fibers. Each interconnect blade may include an insulating layer surrounding the conduits. The insulating layer facilitates the transfer of high frequency signals by a conduit comprising a wire.

The substrate of the blade may be a printed circuit board fabricated from a fiberglass material such as FR4. The blade may further include a carrier foil with interconnect traces formed by an etching process on its surface. The insulating area surrounding the wires may be a material such as air, gas or foam, which guarantee a separation distance for the wire from the surrounding substrate such that the high frequency signals flowing through the wires do not waste their energy into heating the substrate. In the case of using wire pairs for differential signaling, the energy loss will decrease significantly, because the symmetrical signaling waves zero out with increasing distance.

The required room for a better suited environment of the signals within the rear interconnect blade is achieved by the invention of said blade being mounted perpendicular to the plane of a conventional backplane. Several interconnect networks, including full mesh interconnects can be partitioned in a way which is compatible to the solution with an array of interconnect blades built according to the invention.

BRIEF DESCRIPTION OF THE DRAWINGS

These, as well as other features of the present invention, will become more apparent upon reference to the drawings wherein.

DETAILED DESCRIPTION

Figure 1:
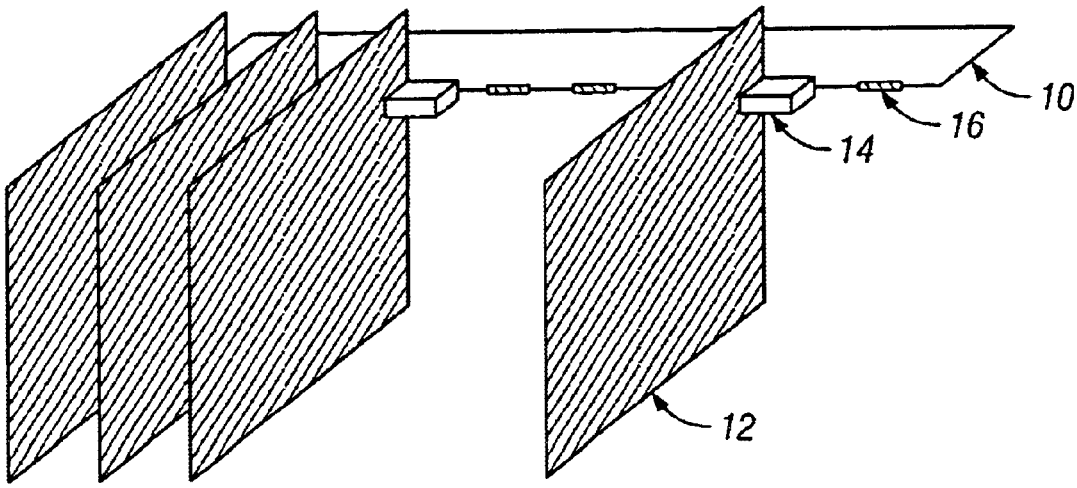
FIG. 1 is a perspective view of a single interconnect blade constructed in accordance with the present invention and operative to receive multiple electronic modules.

Referring now to the drawings wherein the showings are for purposes of illustrating preferred embodiments of the present invention only, and not for purposes of limiting the same, FIG. 1 is a perspective view of a rear interconnect blade 10 operative to interconnect electronic modules 12 in a high speed and low loss manner. Each of the modules 12 is an electronic device, which may support a different technology. In this regard, a module 12 may be a processor module, memory module, power supply, etc. The blade 10 provides a multitude of scenarios for the utilization of high-speed interconnection of modules 12 with electrical or optical medium. An architecture using the blade 10 allows a scalable, configurable rear interconnect having simultaneous support of different technologies. In this regard, the blade 10 provides the basis for a family of possible electromechanical interconnect standards. The blade 10 is typically installed within a chassis (not shown) that provides physical support for the modules 12 inserted therein.

Each module 12 may comprise a rigid printed circuit board (PCB) typically manufactured from a fiberglass material and having a predetermined size. In this regard, the modules 12 may all be the same size in order to meet a desired form factor of the chassis. However, it will be recognized that the modules 12 do not need to be the same size for operation with the interconnect blade 10. Furthermore, modules 12 may consist of more than one board. The module 12 may also be a fully enclosed unit with integrated cooling and power conversion structures.

Each of the modules 12 includes a connector receptacle 14, which mates with a connector 16 available at the edge of the blade 10. Referring to FIG. 1, the connector receptacle 14 is installed perpendicular to the plane of the module 12 and parallel to the plane of the blade 10. In this regard, for the configuration shown in FIG. 1, each of the modules 12 are plugged in from the front of the chassis containing the blade 10 with each of the modules 12 perpendicular to the blade 10.

Connector 16 may be realized as an edge connector that is formed as an extension of the blade 10 and is insertable into the connector receptacle 14. In this regard, the connector receptacle 14 contains a recess for receiving the edge connector 16. As will be further explained below, the edge connector 16 is operative to transfer signals to/from the connector receptacle 14. When the module 12 is inserted into the chassis containing the blade 10, the connector receptacle 14 mates with the edge connector 16 in order to provide the interconnect between the module 12 and the blade 10, as will be further explained below.

Figure 2:
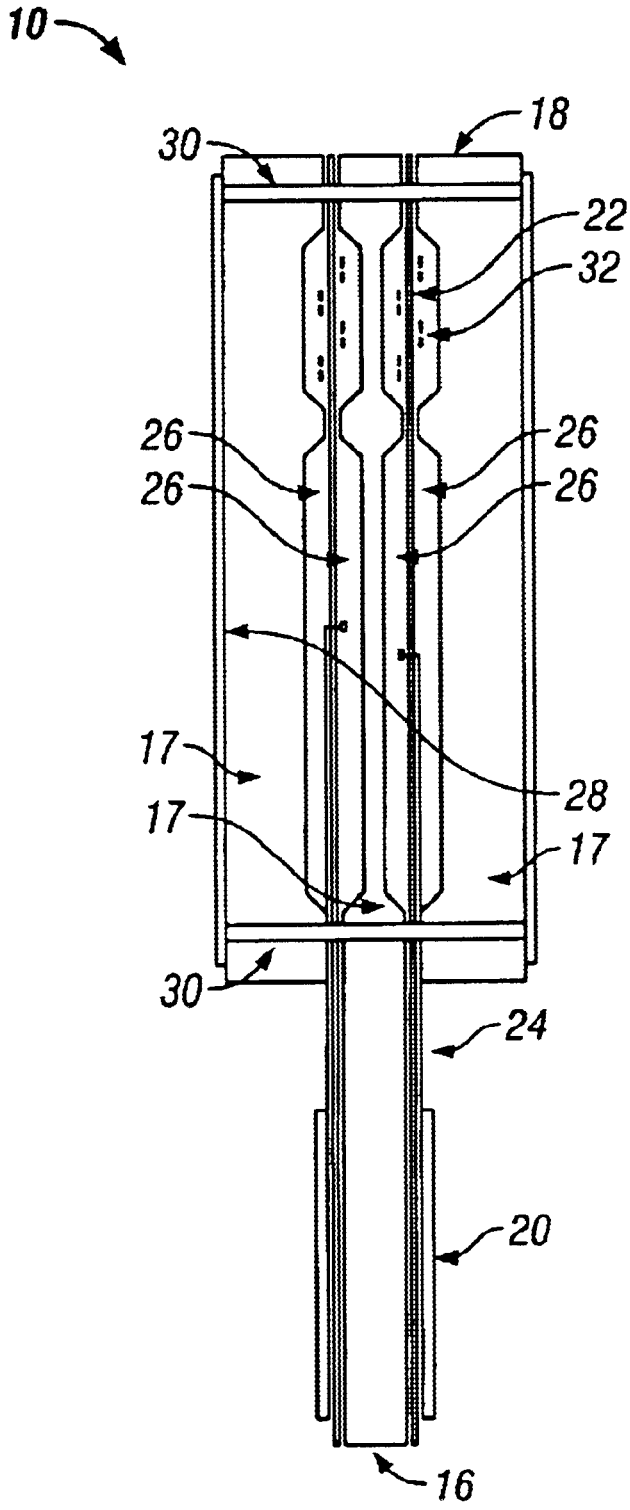
FIG. 2 is a cross-section of the interconnect blade shown in FIG. 1.

Embodiments of the invention may use state of the art techniques for the implementation of the rear interconnect blade. The following exemplary embodiment shows a possible more elaborate implementation. Referring to FIG. 2, a cross-sectional view of the blade 10 is shown. The blade 10 has a core 17 fabricated from a fiberglass material used in circuit board construction such as FR4. The core 17 forms the edge connector 16 and also has a generally planar body portion 18. The edge connector 16 has a thickness which is slightly less than the body portion 18. As previously discussed, the edge connector 16 is sized according to the requirements of the connector receptacle 14.

Formed on the edge connector 16 is a contact area 20, which makes an electrical connection with the connector receptacle 14 when inserted therein. Specifically, the contact area 20 connects with a conductive area of the connector receptacle 14 in order to transfer electrical signals therebetween. The contact area 20 is etched on the surface of a carrier foil 22, which extends from the edge connector 16 through the body portion 18, as seen in FIG. 2. The carrier foil 22 and the contact area 20 are formed using circuit board construction and etching techniques. The contact area 20 may be gold plated copper or some other type of conductive material. A signal wire 24 is formed on the carrier foil 22 and extends into the interior of the body portion 18 from the edge connector 16. The wire 24 transfers the signal from the contact area 20 to the interior of the body portion 18 and to other edge connectors 16. The wire 24 may be constructed from a copper trace etched on the surface of the carrier foil 22. Multiple wires 24 may be formed in order to transfer multiple signals.

The blade 10 further includes an insulating layer 26 in contact with each signal wire 24. The insulating layer 26 may be formed from air, foam, gas, or any other material that does not absorb high frequency energy. As seen in FIG. 2, the insulating layer 26 may be disposed adjacent to the wire 24 such that the wire is in contact with the insulating layer 26 instead of the core 17. The insulating layer 26 prevents the high frequency energy from the signals transmitted in the wire 24 from heating the core 17 and thereby prevents losses in the signals carried by the wire 24. The insulating layer 26 provides a guaranteed minimum distance from the signal conduits (i.e., wire 24) from the core 17 or other carrier material.

Figure 3:
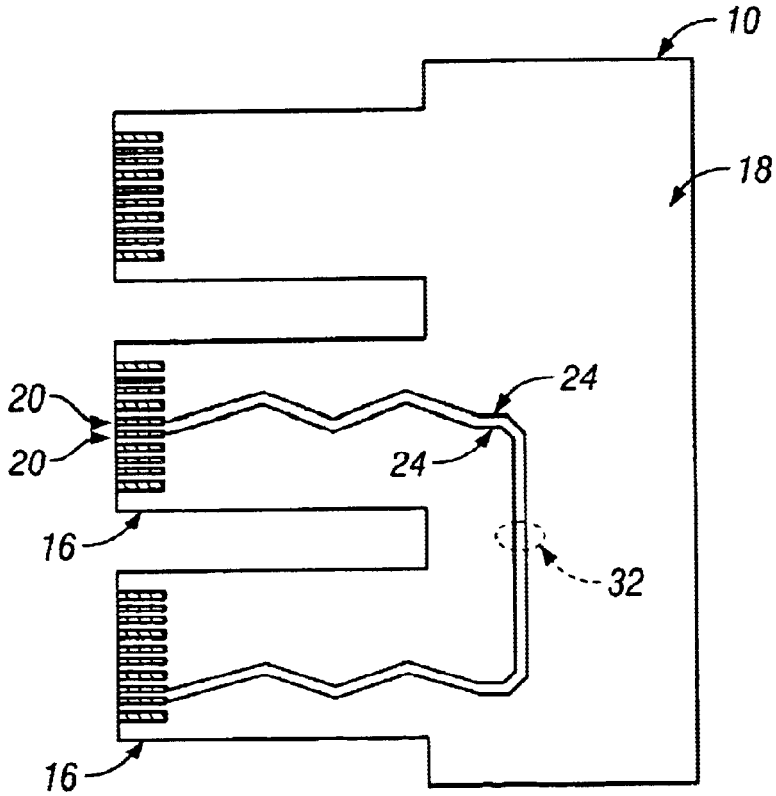
FIG. 3 is a plan view of an interconnect blade with multiple fingers.

The wire 24 can be routed in the proper direction on the blade 10 in order to connect other edge connectors 16. Specifically, referring to FIG. 3, a plan view of the blade 10 is shown illustrating how the wires 24 may be routed. The wires 24 may be routed from different edge connectors 16 of a single blade 10 as a differential signal pair 32 if desired. Referring back to FIG. 2, a cross-sectional view of the differential signal pair 32 is shown. The signal pairs 32 are routed along the length of the blade 10 and are surrounded by the insulating layer 26. Differential pairs may be routed side by side on the same surface of the carrier foil as shown in FIG. 3 or an opposite sides of the carrier foil forming the so called broad side coupling.

The blade 10 further includes ground layers 28 disposed on either side of the body portion 18. The ground layer 28 is made from a conductive material such as copper for EMC containment. The ground layers 28 on both sides of the blade 10 must be interconnected around the perimeter using regularly placed plated vias (through-holes) 30. Each via 30 contains a conductive material-which electrically connects the top and bottom ground layers 28 together. The ground layers 28 are then electrically connected to a ground of the system in order to provide EMC shielding.

As seen in FIG. 2, the wires 24 may be routed on both sides of the carrier foil 22. The wires 24 distribute the signals along the blade 10 between the modules 12. Typically, backplane signal interfaces do not require a random interconnect of the backplane connections of all slots. Bus interconnect signal groups can be easily partitioned to several blades 10, as will be further explained below. Alternatively, the signal groups may be partitioned to separate carrier foils 22 of a single blade 10 without interconnection between the foils 22. Even full mesh interconnects of differential pair signaling connections can be partitioned so that the rear interconnect blades 10 can be used without interconnection between multiple blades 10 or carrier foils 22 within the blades 10 carrying the interconnection. Accordingly, by using multiple blades 10 it is possible to provide interconnect between multiple modules 12 without having a backplane with multiple layers.

The blades 10 support a modular approach to rear interconnect blades. For example, multiple blades 10 can be mounted from the front or the rear of a system enclosure (i.e., chassis). The enclosure and the blades 10 are equipped with matching mounting supports, which provide high position accuracy. The mounting support of the rear interconnect blade 10 includes castellations and guides in the chassis corresponding to castellations on the blade 10 thereby allowing the insertion of the blade 10 to support contiguous subsets of module slots. An example of the modularity of the blade 10 is where a blade 10 can support a full mesh interconnect of all modules by one rear interconnect blade 10 and pair-wise interconnects of the neighboring slots via another rear interconnect blade 10. The interconnects of neighboring modules may be implemented using a number of short blades 10 installed in line instead of one large rear interconnect blade.

As previously discussed above, an edge connector 16 is used to connect with the module 12. The connector 16 may also be any specifically designed indirect connector resembling a standard edge connector. It is also possible to use two part connectors for the edge connector 16. For example, two 90 degree surface mount connectors on both sides of the blade 10 could be used. In this instance, the thickness of the blade 10 has to be within the tolerance requirements of the connectors.

Figure 4:
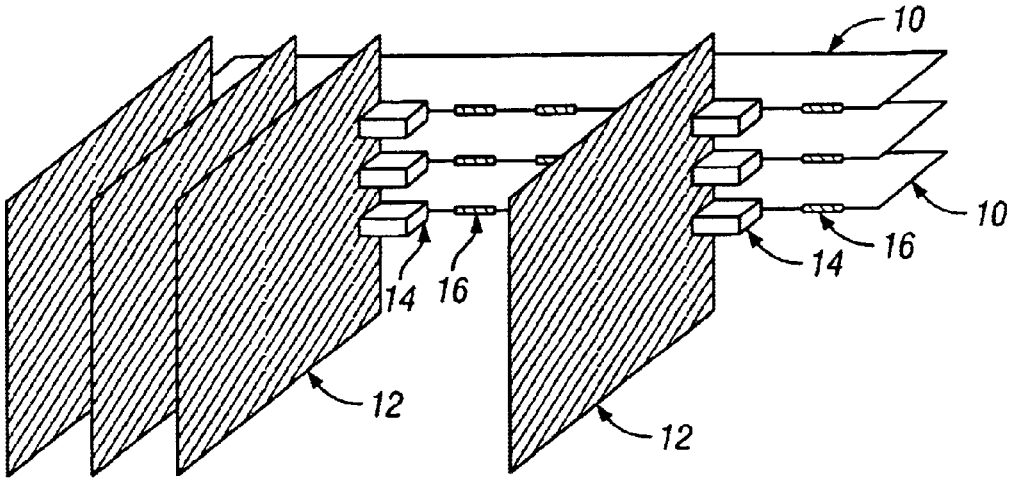
FIG. 4 is a perspective view of vertically mounted electronic modules interconnected by multiple horizontal interconnect blades.

Referring to FIG. 4, a constellation of multiple modules 12 and blades 10 is shown. The modules 12 are inserted vertically, while the blades are horizontal. As seen in FIG. 3, each module 12 is inserted into multiple blades 10 which interconnect the modules 12 together. As mentioned above, each blade 10 can provide interconnection for differential signaling pairs between the modules 12.

By using multiple blades 10 in a system configuration it is possible to provide interconnections between multiple modules 12 without using a single common backplane. For instance, a single blade 10 can be used to interconnect data signals, while another blade 10 can be used to interconnect control signals. In this regard, it is possible to assign signals to certain blades 10.

Figure 5:
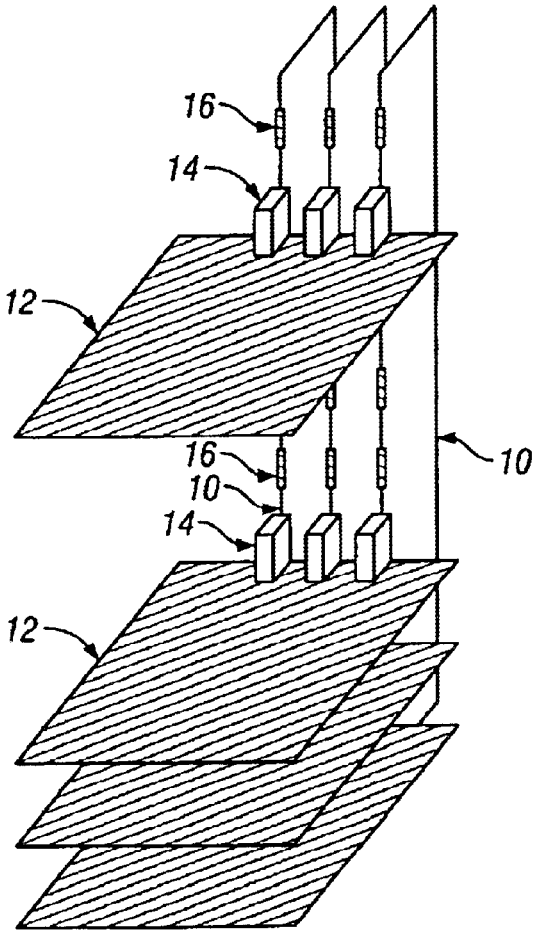
FIG. 5 is a perspective view of horizontally mounted electronic modules interconnected by multiple vertical interconnect blades.

Referring to FIG. 5, rear mounted vertical interconnect blades 10 are shown. In this configuration, the blades 10 are vertical and the modules 12 are horizontal. The benefit of this configuration is that front to back cooling of the modules 12 is possible by the blades providing a path for vertical airflow. Furthermore, this configuration can be implemented as an interconnect architecture for 1U (1.75 inches high) module enclosures.

Figure 6:
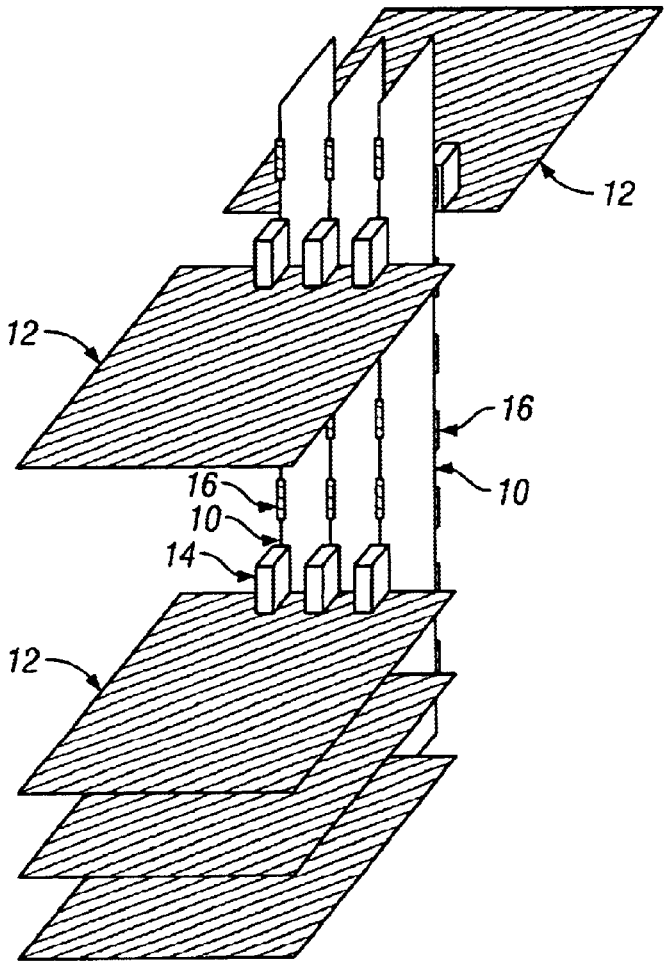
FIG. 6 is a perspective view of multiple vertical interconnect blades with module connectors on both sides.

Referring to FIG. 6, a vertical blade configuration wherein the modules 12 are inserted into both sides of the blades 10 is shown. In the configuration of FIG. 6, the modules 12 are inserted into either side of the blades 10 in order to provide more interconnection flexibility. In the configuration shown in FIG. 6, the blades 10 are in the center of the enclosure and the modules 12 are inserted from two opposite sides thereof. The multiple blades 10 form a backbone of the system. Vertical air flow is possible in the middle of the chassis, between the interconnect blades.

Figure 7:
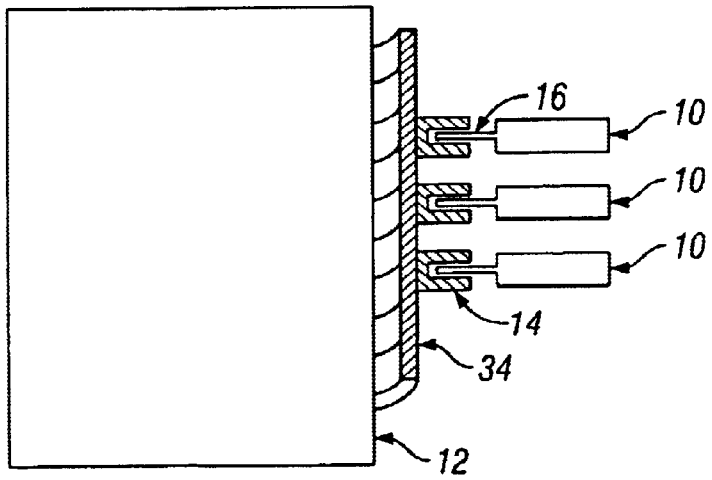
FIG. 7 is a perspective view of an electronic module having a flexible printed circuit board for connectors that mate with interconnect blades.

An implementation of the vertical blade configurations shown in FIGS. 5 and 6 is shown in FIG. 7. A single module 12 is connected to multiple blades 10 through the use of a flexible printed circuit board (PCB) 34. In this regard, the PCB 34 is operative to provide a rear connection point for the connector receptacles 14 while still maintaining an orientation, which is perpendicular to the module 12. The rear of each connector receptacle is attached to the PCB 34 such that each of the connector receptacles 14 is then insertable into a respective one of the edge connectors 16.

Depending on the application, electronic components may or may not be used on the blades 10. If electronic components are used on the blades 10, they may be passive or active depending upon the complexity of the implementation. Furthermore, the electronic complexity of the blade 10 may be lower than, similar to, or greater than the complexity of the modules 12 depending upon the application. The blades 10 may serve as mediators (adapters) of rear connections for the front inserted module. The blades 10 may further be adapted to carry air movers or mass storage devices that may be replaceable via front or rear access to the system. As a superiority over systems designed with conventional backplanes, a system using the interconnect architecture provided by the invention, can support a live insertion and removal of the blade 10 units. In systems with exchangeable blades the limitations for the usage of active components on the interconnect blades will not be required, especially if the interconnect is partitioned into multiple blades in a way that the system can tolerate the removal of one of these blades under operational conditions.

It will be recognized that the modules 12 may be heavy and need to be supported when inserted into the chassis containing the blade(s) 10. The connector receptacles 14 must be aligned with the edge connectors 16 when the module 12 is inserted. Alignment pins may be used to align the module connector receptacle 14 with the edge connector 16 of the blade 10. This type of construction adds a mechanical support task to the blade. If the weight of the modules is very high, the blades cannot fulfill the task of supporting them.

Alternatively, it is possible to route the transfer wires 24 further from the modules 12 in order to form fingers, which allow flexible alignment of the edge connector 16. Each of the edge connectors 16 may be lengthened to form individual fingers, as shown in FIG. 7. Each of the fingers has the capability of being deformed to a certain extent without compromising the structural integrity of the blade 10. By specific choice of the materials, the signal layout, and the formation of the fingers, it is possible to provide flexibility to the fingers, which allow deformation within mechanical tolerances. The flexibility of the finger allows alignment between the module 12 and the blade 10. The fingers and module 12 need to have alignment features installed in order to support successful engagement over a wide range of tolerances. In this case, the weight of the modules is supported by mechanical structures and guides designed for the purpose.

The interconnect blades 10 can further provide redundant interconnects using separate blades to provide alternate resources. For instance, two blades 10 may be used for redundant power distribution that allow an exchange of a faulted blade under conditions of full or degrade service instead of taking a complete shelf or rack out of service for the replacement procedure. Furthermore, in a full mesh interconnect system, the interconnects can be grouped into subgroups so that one blade 10 can contain one quarter of the interconnect and another blade 10 can take another quarter of the interconnect, and so on. If there is a failure in one of the blades 10, then the faulted blade 10 could be removed and the performance of the system would only be degraded by one quarter. In systems using conventional backplanes, the entire system needs to be powered down in order to replace a faulted backplane.

It will be recognized that the blades 10 allow different module depths at different positions within the system. By custom designing each blade 10, it is possible to adapt the blade 10 for the desired depth of the module 12. Furthermore, flexible solutions are achievable by telescopic extender mechanisms if flexible carriers for the conduits are applied.

Additional modifications and improvements of the present invention may also be apparent to those of ordinary skill in the art. For example, the blades 10 may be configured to provide optical signal paths for the distribution of optical signals. Thus, the particular combination of parts described and illustrated herein is intended to represent only certain embodiments of the present invention, and is not intended to serve as limitations of alternative devices within the spirit and scope of the invention.

We claim:

1. A system for distributing signals between at least two electronic modules, the system comprising at least one interconnect blade having one or more conductors coupling each of the electronic modules, said at least one interconnect blade mounted substantially perpendicular to the modules such that an edge of the blade disposes coupling capabilities toward the modules, wherein the one or more conductors comprise one or more wires having insulation surrounding a portion of the one or more wires.

2. The system of claim 1 wherein each blade further comprises at least two connection areas for connecting with the respective electronic modules.

3. The system of claim 2 wherein the interconnect blade comprises signal conversion apparatus for facilitating high-speed data transfer.

4. The system of claim 3 wherein the signal conversion apparatus comprises electro-optical coupling apparatus.

5. The system of claim 2 wherein each blade further comprises a ground layer.

6. The system of claim 2 wherein each blade further comprises a plurality of wires interconnecting multiple contact areas of the blade.

7. The system of claim 2 wherein neighboring wires on a blade are routed as wire pairs.

8. The system of claim 1 wherein the one or more conductors comprise one or more optical conduits capable of transferring optical signals.

9. The system of claim 1 wherein some blades are electrically connected to one another in order to transfer signals therebetween.

10. An interconnect blade for distributing signals between at least two electronic modules, the blade comprising:

a substrate;

at least two edge connectors formed in the substrate, each edge connector corresponding to one of the electronic modules;

at least one conductor coupled to the edge connectors, the conductor providing a path for distributing signals between the edge connectors, wherein the one or more conductors comprise one or more wires having insulation surrounding a portion of the one or more wires.

11. The blade of claim 10 wherein the substrate comprises a printed circuit board.

12. The blade of claim 11 wherein the printed circuit board is formed from FR4.

13. The blade of claim 10 wherein the at least one conductor comprises a carrier foil formed within a layer of the substrate.

14. The blade of claim 10, wherein said insulation is formed from a material from the group consisting of:

air;

gas; and foam.

15. The blade of claim 10 further comprising a ground layer disposed on both sides of the substrate in order to mitigate electromagnetic interference.

16. The blade of claim 10 wherein each edge connector is configured to be connectable with a connector of each of the electronic modules.

17. The blade of claim 10 wherein the at least one conductor comprises at least two wires configured as pairs of wires for differential signaling.

18. The blade of claim 10 wherein the at least one conductor comprises at least one optical fiber configured to distribute optical signals.

19. The blade of claim 10 wherein some of the conductors are used for power distribution.

20. The blade of claim 10 which can be removed and replaced in a system during operational conditions.

21. An apparatus for distributing mutually exclusive signals between a first electronic module and a second electronic module, the apparatus comprising:

a first interconnect blade electrically connecting the first and second electronic modules, said first interconnect blade having one or more conductors wish one or more wires having insulation surrounding a portion of the one or more wires; and a second interconnect blade electrically connecting the first and second electronic modules, said second interconnect blade having one or more conductors with one or more wires having insulation surrounding a portion of the one or more wires, wherein said first interconnect blade distributes a first set of signals between the first and second electronic modules, wherein said second blade distributes a second set of signals between the first and second electronic modules, and wherein the first set of signals is different than the second set of signals.

22. The apparatus of claim 21 wherein the first set of signals is a first set of differential pair of signals and the second set of signals is a second set of differential pair of signals.

23. The apparatus of claim 21 wherein the signals are optical signals.

24. A method for distributing signals between multiple electronic modules, the method comprising:

coupling the electronic modules with at least one interconnect blade, said at least one interconnect blade mounted substantially perpendicular to the electronic modules; and distributing the signals between the two electronic modules; and wherein said at least one interconnect blade comprises has one or more conductors with one or more wires having insulation surrounding a portion of the one or more wires.

25. The method of claim 24 wherein the signals are optical signals.

* * * * *